US010232218B2

(12) United States Patent
Carr

(10) Patent No.: US 10,232,218 B2
(45) Date of Patent: Mar. 19, 2019

(54) MULTI-PLANAR ROTATIONAL PLATFORM AND SUSPENSION DEVICE

(71) Applicant: Olden Carr, Irvine, CA (US)

(72) Inventor: Olden Carr, Irvine, CA (US)

( * ) Notice: Subject to any disclaimer, the term of this patent is extended or adjusted under 35 U.S.C. 154(b) by 0 days.

(21) Appl. No.: 15/649,854

(22) Filed: Jul. 14, 2017

(65) Prior Publication Data

US 2018/0015322 A1 Jan. 18, 2018

Related U.S. Application Data

(60) Provisional application No. 62/362,124, filed on Jul. 14, 2016.

(51) Int. Cl.
*A63B 22/18* (2006.01)
*A63B 22/20* (2006.01)

(52) U.S. Cl.
CPC ..... *A63B 22/203* (2013.01); *A63B 22/18* (2013.01); *A63B 22/205* (2013.01); *A63B 2022/206* (2013.01)

(58) Field of Classification Search
CPC ..... A63B 22/20; A63B 22/18; A63B 22/16; A63B 2022/20; A63B 23/02
See application file for complete search history.

(56) References Cited

U.S. PATENT DOCUMENTS 4,176,836 A * 12/1979 Coyle ..... A63B 21/0622 482/96
4,744,558 A * 5/1988 Smirmaul ..... A63B 69/18 434/253
5,192,258 A * 3/1993 Keller ..... A63B 69/18 434/253
5,232,423 A * 8/1993 Hajduczek ..... A63B 26/003 482/66
5,833,584 A * 11/1998 Piaget ..... A63B 22/0012 482/70
6,440,045 B1 * 8/2002 Gaston ..... A63B 21/012 482/140
6,786,850 B2 * 9/2004 Nizamuddin ..... A63B 21/157 482/51

(Continued)

*Primary Examiner* — Garrett K Atkinson
(74) *Attorney, Agent, or Firm* — Richard D. Clarke

(57) ABSTRACT

The present invention relates to a device which enables a selective therapeutic exercise regimen by providing a tensioning mechanism attached to a rotatable platform along with the unique feature is where two trollies on curved rails operating on X-axis and Y-axis when pressure is applied, will work in unison to travel in any desired direction creating a unique spherically rotational reaction. The platform will react to changes in the operator's weight shifts and center of gravity placed upon it. When this novel multi-rotational aspect of the platform responds to subtle changes in the operator's center of gravity, movement of the platform will occur. These changes trigger muscular contractions around the joints of the operator responding to the rotation of the platform while the tensioning mechanism allows for selective resistance to the free movement of the platform enabling selective exercise and therapy routines for various muscle groups. Additionally, the present Multi-Planar Rotational Platform and Suspension Device offers easy scalability and uniform or non-uniform scaling in the X-axis, the Y-axis and/or the Z-axis.

20 Claims, 9 Drawing Sheets

(56) References Cited

U.S. PATENT DOCUMENTS 7,115,073 B2 * 10/2006 Nizamuddin ..... A63B 21/055 482/51
D565,134 S * 3/2008 Brown ..... D21/687
7,357,767 B2 * 4/2008 Tsai ..... A63B 21/0004 482/146
D584,367 S * 1/2009 Augustine ..... D21/662
7,556,592 B2 * 7/2009 Nizam ..... A63B 21/055 482/51
7,713,181 B1 * 5/2010 Durham ..... A63B 22/20 482/139
7,811,217 B2 * 10/2010 Odien ..... A63B 21/0058 482/147
D626,608 S * 11/2010 Tsai ..... D21/689
D631,519 S * 1/2011 Chen ..... D21/689
7,878,957 B1 * 2/2011 Chen ..... A63B 22/0046 482/131
7,935,032 B1 * 5/2011 Jackson ..... A63B 22/0046 482/70
7,935,033 B2 * 5/2011 Blessing ..... A63B 22/0061 482/51
7,955,240 B2 * 6/2011 Nadim ..... A63B 21/0618 482/146
7,985,169 B2 * 7/2011 Tudico ..... A61H 1/001 482/147
8,043,199 B1 * 10/2011 Barker ..... A63B 22/0023 482/132
D659,777 S * 5/2012 Watterson ..... D21/689
D660,383 S * 5/2012 Watterson ..... D21/689
D671,177 S * 11/2012 Sip ..... D21/689
D671,178 S * 11/2012 Sip ..... D21/689
8,668,633 B2 * 3/2014 Ho ..... A63B 22/0087 482/131
8,721,510 B2 * 5/2014 Chung-Ting ..... A63B 21/015 482/132
8,727,956 B2 * 5/2014 Ho ..... A63B 21/068 482/132
8,870,726 B2 * 10/2014 Watterson ..... A63B 22/14 482/132
8,944,973 B2 * 2/2015 Lalaoua ..... A63B 21/02 482/121
9,700,756 B2 * 7/2017 Franche ..... A63B 22/16
2002/0042329 A1 * 4/2002 Nizamuddin ..... A63B 21/157 482/51
2002/0177511 A1 * 11/2002 Jang ..... A61H 15/00 482/146
2004/0241631 A1 * 12/2004 Nizamuddin ..... A63B 21/055 434/253
2007/0027010 A1 * 2/2007 Tsai ..... A63B 21/0004 482/146
2007/0179022 A1 * 8/2007 Chen ..... A63B 69/0093 482/51
2008/0161175 A1 * 7/2008 Ho ..... A63B 22/14 482/146
2009/0176631 A1 * 7/2009 Blessing ..... A63B 22/0061 482/71
2010/0222187 A1 * 9/2010 Tudico ..... A61H 1/001 482/110
2012/0115694 A1 * 5/2012 Chen ..... A63B 22/205 482/142
2012/0115695 A1 * 5/2012 Watterson ..... A63B 22/14 482/142
2014/0011647 A1 * 1/2014 Lalaoua ..... A63B 21/02 482/125
2015/0343261 A1 * 12/2015 Liptack ..... A63B 22/16 482/80

* cited by examiner

MULTI-PLANAR ROTATIONAL PLATFORM AND SUSPENSION DEVICE

FIELD OF THE INVENTION

The present invention relates to a new and improved exercise and physical therapy device. More particularly, the present invention relates to a multi-planar rotational platform and suspension device which enables a selective therapeutic exercise regimen by providing a selective tension controlling mechanism attached to a rotatable platform that will additionally oscillate on the X-axis and Y-axis to produce a partial semi-spherical movement, additionally resulting in a Z-axis movement, that will react to the operator's shifting of weight.

BACKGROUND OF THE INVENTION

The present invention relates to a device which enables a selective therapeutic exercise regimen by providing a tensioning mechanism attached to the rotating platform. The unique feature is where two trollies on curved rails operating on X-axis and Y-axis when pressure is applied, will work in unison to travel in any desired partial semi-spherical direction, namely, the Z-axis. The X-axis trolley system will be mounted on the lower base plate while the Y-axis trolley system will be mounted on the upper support plate housing the bearing and support rollers fair the rotating platform. It is also anticipated that the multi-planar rotational device may be suspended from a bar or ceiling.

Today's modern occupations are primarily sedentary and non-physical in nature. Time constraints require more home or office based exercise devices and because of increased urbanization, space requirements for an exercise apparatus are often limited.

In addition, therapy of joint related injuries may require time consuming and expensive visits to facilities which maintain complex equipment for exercising and rehabilitation of various parts of the body.

U.S. Pat. No. 6,176,817 B1 of Anthony B. Carey and Olden Carr (the present inventor) describes a device which enables a selective therapeutic exercise regimen by providing a tensioning mechanism attached to a horizontally and vertically rotatable platform, provided with a safety hand rail to aid in maintaining balance and a vertical posture for the operator. The dish-shaped platform will react to changes in the operator's weight shifts and center of gravity placed upon it. When this novel multi-rotational aspect of the platform responds to subtle changes in the operator's center of gravity, movement of the dish-shaped platform will occur. Because the present inventor Olden Can is an inventor listed on this U.S. Patent, this reference should be considered Applicant Admitted Prior Art (AAPA).

This patent describes a device using a dish-shaped platform with horizontally and vertically enabled movements. It does not describe the unique action where two trollies on curved rails operating on X-axis and Y-axis where when pressure is applied, they will work in unison to travel in any desired spherical direction.

None of these previous efforts, however, provides the benefits attendant with the present Multi-Planar Rotational Platform and Suspension Device. The present Multi-Planar Rotational Platform and Suspension Device achieves its intended purposes, objects and advantages over the prior art devices through a new, useful and unobvious combination of method steps and component elements, with the use of a minimum number of functioning parts, at a reasonable cost to manufacture, and by employing readily available materials. Additionally, the present Multi-Planar Rotational Platform and Suspension Device offers easy scalability and uniform or non-uniform scaling in the X-axis, the Y-axis and/or the Z-axis.

In this respect, before explaining at least one embodiment of the Multi-Planar Rotational Platform and Suspension Device in detail it is to be understood that the Multi-Planar Rotational Platform and Suspension Device is not limited in its application to the details of construction and to the arrangement of the components set forth in the following description or illustrated in the drawings. The Multi-Planar Rotational Platform and Suspension Device is capable of other embodiments and of being practiced and carried out in various ways. Also, it is to be understood that the phraseology and terminology employed herein are for the purpose of description only and should not be regarded as limiting.

SUMMARY OF THE INVENTION

The principle advantage of the Multi-Planar Rotational Platform and Suspension Device is that it is relatively small in size for a multipurpose exercise device, and can take either the form of a platform or a suspended configuration.

Another advantage is the smooth motion of the two trollies working in unison on the rails to create the spherically rotational action.

And still another advantage is to have a single device that will produce two or more separate exercise movements.

Another advantage having a first alternate embodiment of the Multi-Planer Rotational Device and Suspension Device to be mounted on a vertical rod or ceiling.

Another advantage is having a second alternate embodiment of the Multi-Planer Rotational Device and Suspension Device with a different style of dolly and rail configuration.

Another advantage is having a third alternate embodiment of the Multi-Planer Rotational Device and Suspension Device using curved rails having a flat track for the rollers or roller wheels.

The present invention relates to a device which enables a selective therapeutic exercise regimen by providing a tensioning mechanism attached to the rotating platform. The unique feature is where two trollies on curved rails operating on X-axis and Y-axis where when pressure is applied, will work in unison to travel in any desired direction creating a unique spherically rotational reaction. The X-axis trolley system will be mounted on the lower base plate while the Y-axis trolley system will be mounted on the upper support plate housing the bearing and support rollers for the rotating platform. An adjustable tension mechanism is attached to the base mounting plate to create a restriction of all the combined movements of the device.

A first alternate embodiment of the Multi-Planer Rotational Device and Suspension Device to be mounted on a vertical rod or ceiling where a person can hold onto the ends of the contoured round rails or the rail support bars and do a variety of exercise movements with the device is mounted on a horizontal bar or mounted on the ceiling.

A second alternate embodiment of the Multi-Planer Rotational Device and Suspension Device with a different style of dolly and rail configuration where only one set of contoured dolly rollers will be used to hold the device together.

A third alternate embodiment of the Multi-Planer Rotational Device and Suspension Device using curved rails having a flat track for the rollers or roller wheels.

These types of exercises trigger muscular contractions around the joints of the operator responding to the rotation of the platform while the tensioning mechanism allows for selective resistance to the free movement of the platform enabling exercise and therapy routines for various muscle groups.

With respect to the above description then, it is to be realized that the optimum dimensional relationships for the parts of the Multi-Planar Rotational Platform and Suspension Device to include variations in size, materials, shape, form, function and manner of operation, assembly and use, are deemed readily apparent and obvious to one skilled in the art, and all equivalent relationships to those illustrated in the drawings and described in the specification are intended to be encompassed by the present Multi-Planar Rotational Platform and Suspension Device. Therefore, the foregoing is considered as illustrative only of the principles of the Multi-Planar Rotational Platform and Suspension Device. Further, since numerous modifications and changes will readily occur to those skilled in the art, it is not desired to limit the Multi-Planar Rotational Platform and Suspension Device to the exact construction and operation shown and described, and accordingly, all suitable modifications and equivalents may be resorted to, falling within the scope of the Multi-Planar Rotational Platform and Suspension Device.

BRIEF DESCRIPTION OF THE DRAWINGS

The accompanying drawings, which are incorporated in and form a part of this specification, illustrate embodiments of the Multi-Planar Rotational Platform and Suspension Device and together with the detailed description, serve to explain the principles of this Multi-Planar Rotational Platform and Suspension Device embodiments.

For a fuller understanding of the nature and objects of the invention, reference should be had to the following detailed description taken in conjunction with the accompanying drawings which are incorporated in and form a part of this specification, illustrate embodiments of the invention and together with the description, serve to explain the principles of this invention.

DETAILED DESCRIPTION OF THE PREFERRED EMBODIMENTS

As required, detailed embodiments of the present Multi-Planar Rotational Platform and Suspension Device are disclosed herein, however, it is to be understood that the disclosed embodiments are merely exemplary of the Multi-Planar Rotational Platform and Suspension Device that may be embodied in various forms. Therefore, specific functional and structural details disclosed herein are not to be interpreted as limiting, but merely as basic for the claims and as a representative basis for teaching one skilled in the art to variously employ the present Multi-Planar Rotational Platform and Suspension Device in virtually any appropriately detailed structure.

Figure 1:
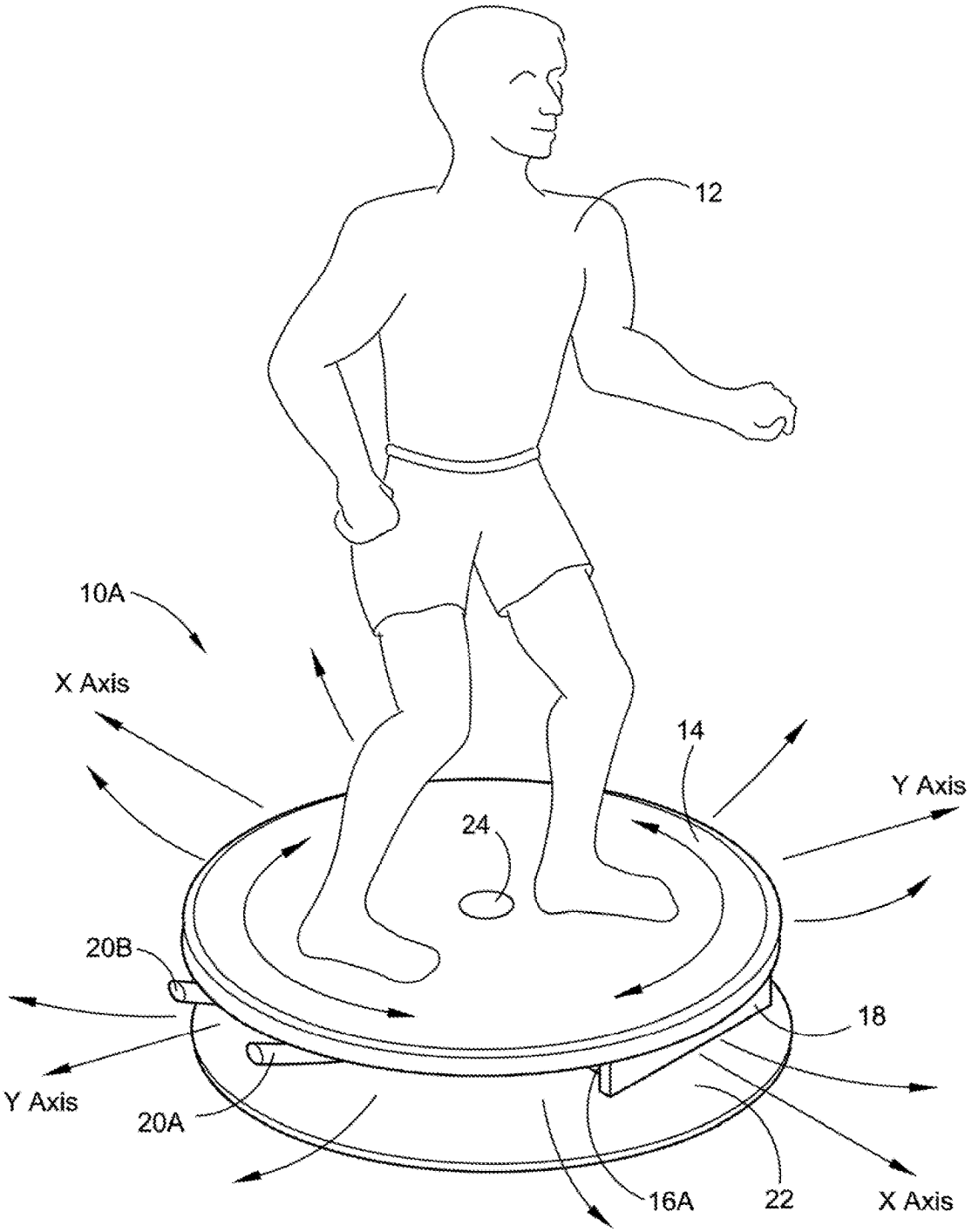
FIG. 1 depicts a perspective view of a person standing on the preferred embodiment of the Multi-Planar Rotational Platform and Suspension Device.

Referring now to the drawings, wherein similar parts of the Multi-Planar Rotational Platform and Suspension Device embodiments 10A, 10B, 10C and 10D are first identified by like reference numerals in FIG. 1, by a perspective view of the preferred embodiment of the Multi-Planar Rotational Platform and Suspension Device 10A with a person 12 standing on the rotating platform 14, illustrating where the rotating platform 14 will react to changes in the operator's weight shifts and center of gravity. Curved round rails 16A and 16B lie on the X-axis of the device attached by the means of the rail mounting plates 18 while the curved round rails 20A and 20B lie on the Y-axis of the device with the base mounting plate 22 below. The rotating platform 14 pivots on the bearing shaft 24.

Figure 2:
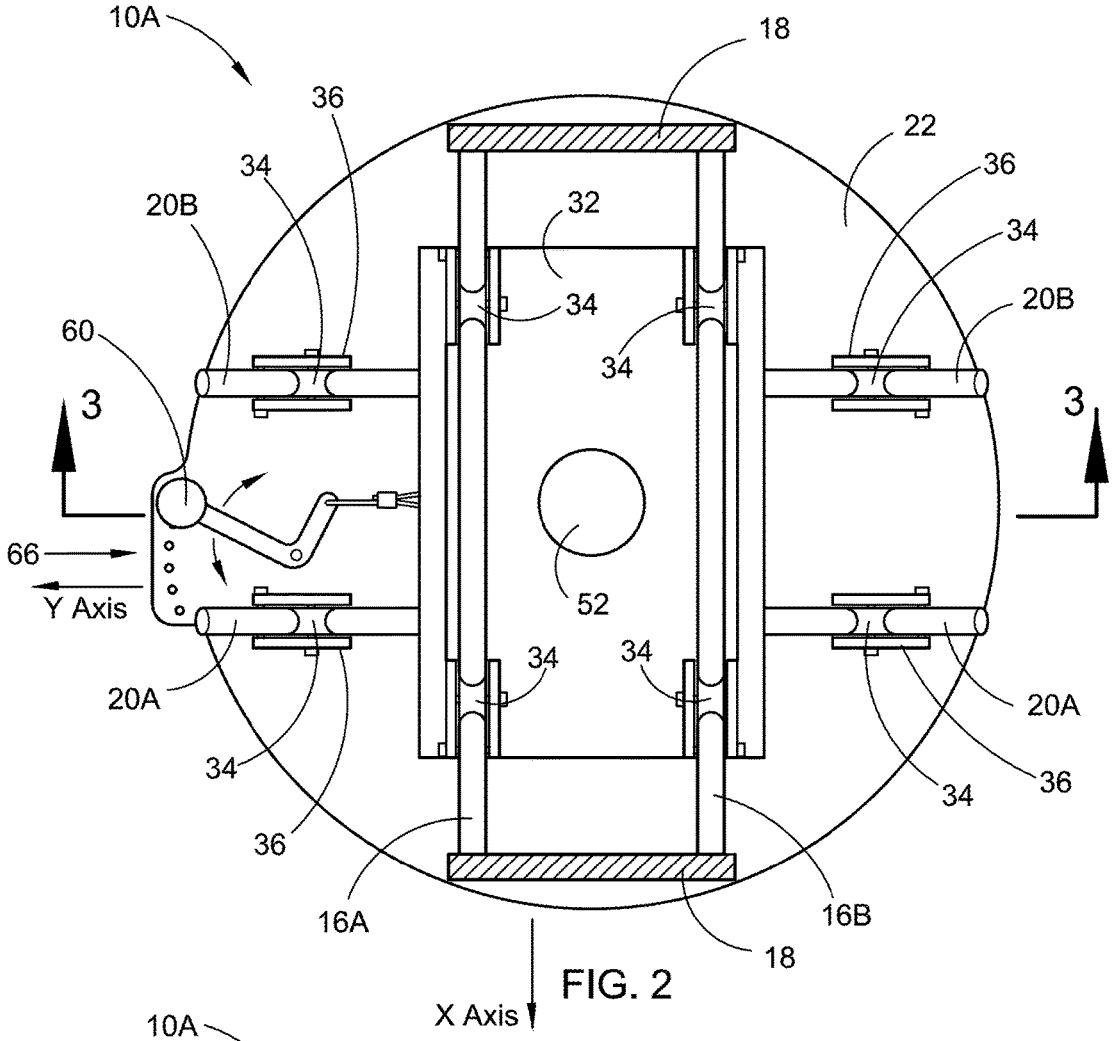
FIG. 2 depicts a top view of the preferred embodiment of the Multi-Planar Rotational Platform and Suspension Device with the rotating platform removed to clarify the internal mechanisms.

FIG. 2 depicts a top view of the preferred embodiment of the Multi-Planar Rotational Platform and Suspension Device 10A with the rotating platform 14 removed to clarify the internal mechanisms. The two curved round rails 16A and 16B are attached to the two rail mounting units 18 on either side of the upper stationary plate 30 allowing the rotating platform 14 to rock back and forth on the X-axis. The dolly frame 32 freely translates back and forth by the means of the four contoured dolly rollers 34 on the corners. The four curved round rails segments 20A and 20B are attached on the Y-axis to dolly frame 32 and are supported by the means of four roller support units 36. By applying pressure in any direction on the rotating platform 14 a fully spherical motion is achieved along with the additional rotation of the rotating platform 14. The adjustable tension mechanism 60 is shown attached to the base mounting plate 22 to create a restriction of all the combined movements of the device.

Figure 3:
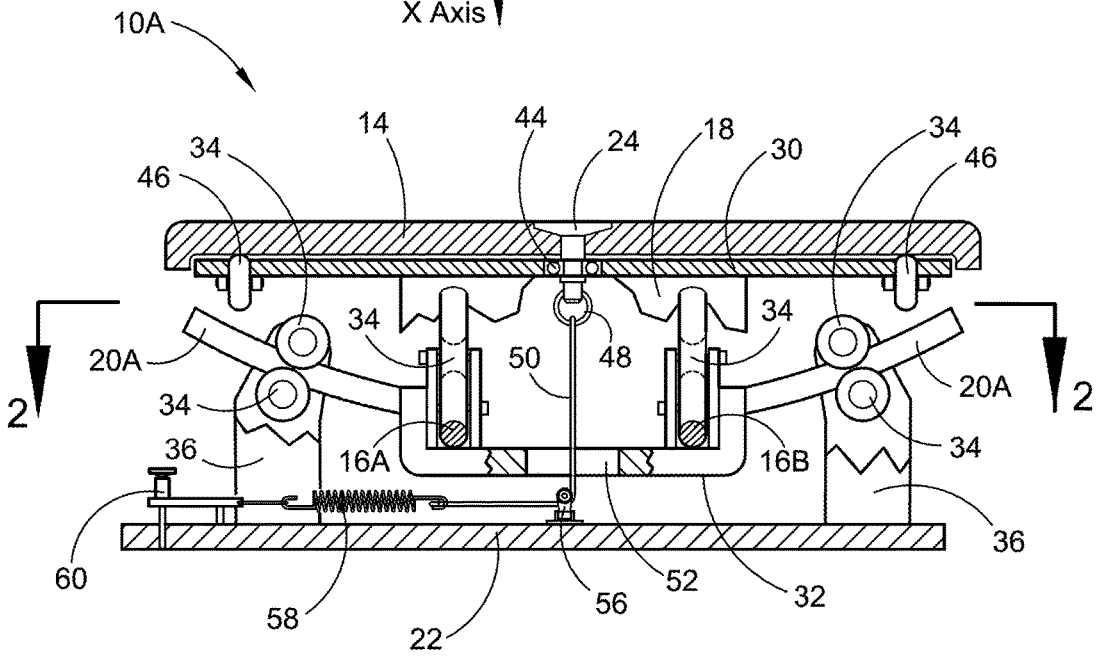
FIG. 3 depicts a front cross section view of the preferred embodiment of the Multi-Planar Rotational Platform and Suspension Device.
Figure 11:
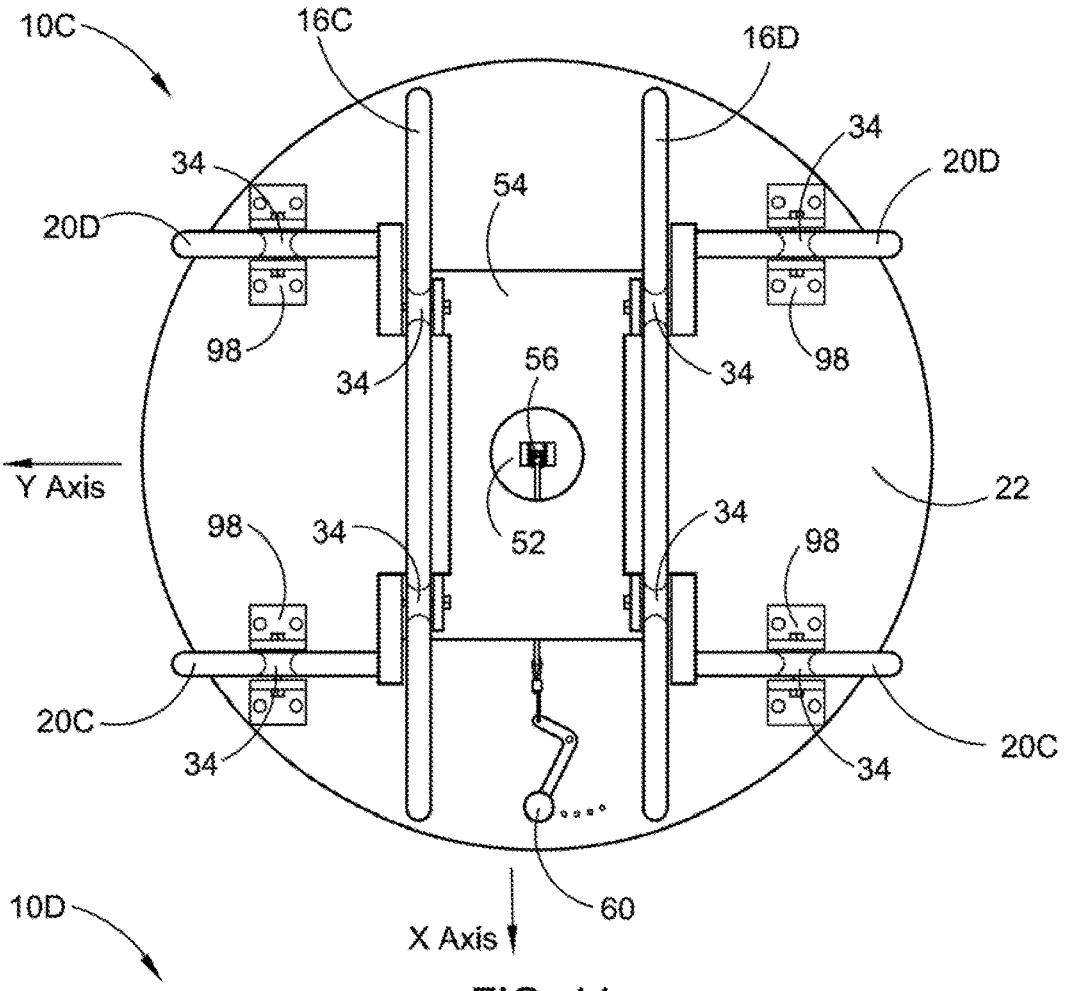
FIG. 11 depicts a top view of the second alternate embodiment of the Multi-Planar Rotational Platform and Suspension Device with the rotating platform removed to clarify the internal mechanisms.

FIG. 3 depicts a front cross section view of the preferred embodiment of the Multi-Planar Rotational Platform and Suspension Device 10A illustrating the shape of the rotating platform 14 with the bearing shaft 24 through to the bearing 44 in the upper stationary plate 30. The upper stationary plate 30 includes rollers 46 on the perimeter for stability of the rotating platform 14. At the lower end of the bearing shaft 24 is a ring 48 attached to the tensioning cable 50 that goes down through an orifice 52 in the dolly frame 32 to a swivel pulley 56 mounted on the base mounting plate 22 and then to the tensioning spring 58. The distal end of the tensioning spring 58 is attached to the adjustable tensioning 60. The adjustment lever 60 is movably affixed to the base mounting plate 22. The adjustment lever 60 has a knob which raises a pin and the pin can be replaced into another hole (see FIG. 14) thereby increasing the tension on the tensioning cable 50 and tensioning spring 58, which puts downward pressure on the platform 14 through swivel pulley 56 and ring 48 attached to bearing shaft 24 at the central axis of platform 14. This increased downward pressure restricts the movement of the rotating platform 14. Curved round rail segments 20A and 20B are attached to either side of the dolly frame 54 (as shown in FIG. 11) and translate through contoured dolly rollers 34 that are mounted on the roller support units 36.

Figure 4:
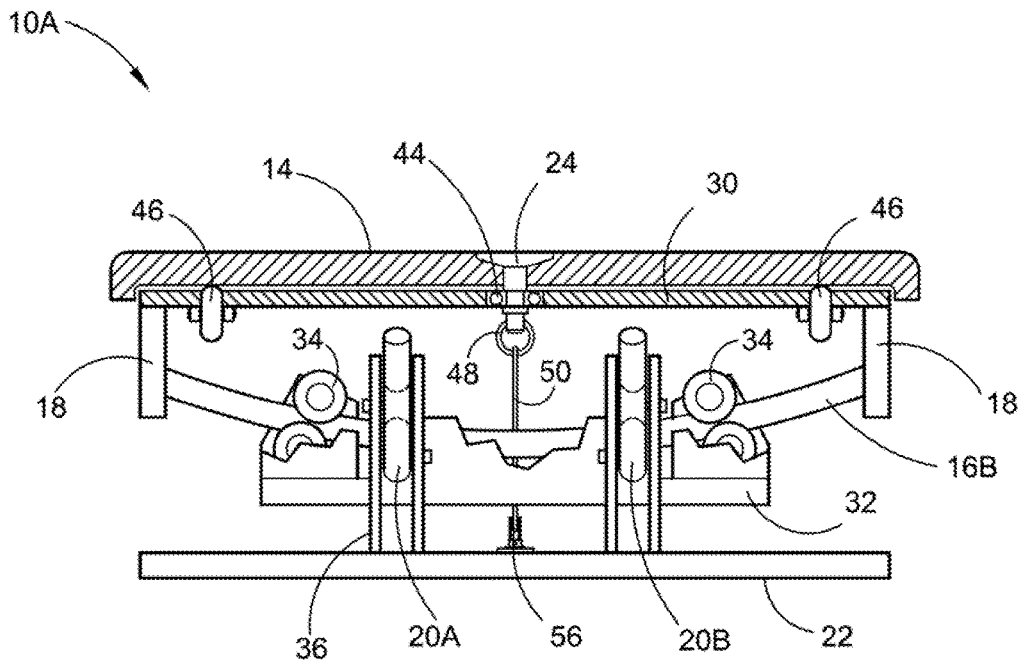
FIG. 4 depicts a side cross section view of the preferred embodiment of the Multi-Planar Rotational Platform and Suspension Device.

FIG. 4 depicts a side cross section view of the preferred embodiment of the Multi-Planar Rotational Platform and Suspension Device 10A illustrating the shape of the rotating platform 14 with the bearing shaft 24 through to the bearing 44 in the upper stationary plate 30. The upper stationary plate 30 had rollers 46 on the perimeter for stability of the rotating platform 14. At the lower end of the bearing shaft 24 is a ring 48 attached to the tensioning cable 50 that goes down through an orifice 52 in the dolly frame 32 to a swivel pulley 56 mounted on the base mounting plate 22 and then to the tensioning spring 58. The distal end of the tensioning spring 58 is attached to the adjustable tensioning device 60. Curved round rail segments 20A and 20B are attached to either side of the dolly frame 32 and translate through contoured dolly rollers 34 that are mounted on the roller support units 36.

Figure 5:
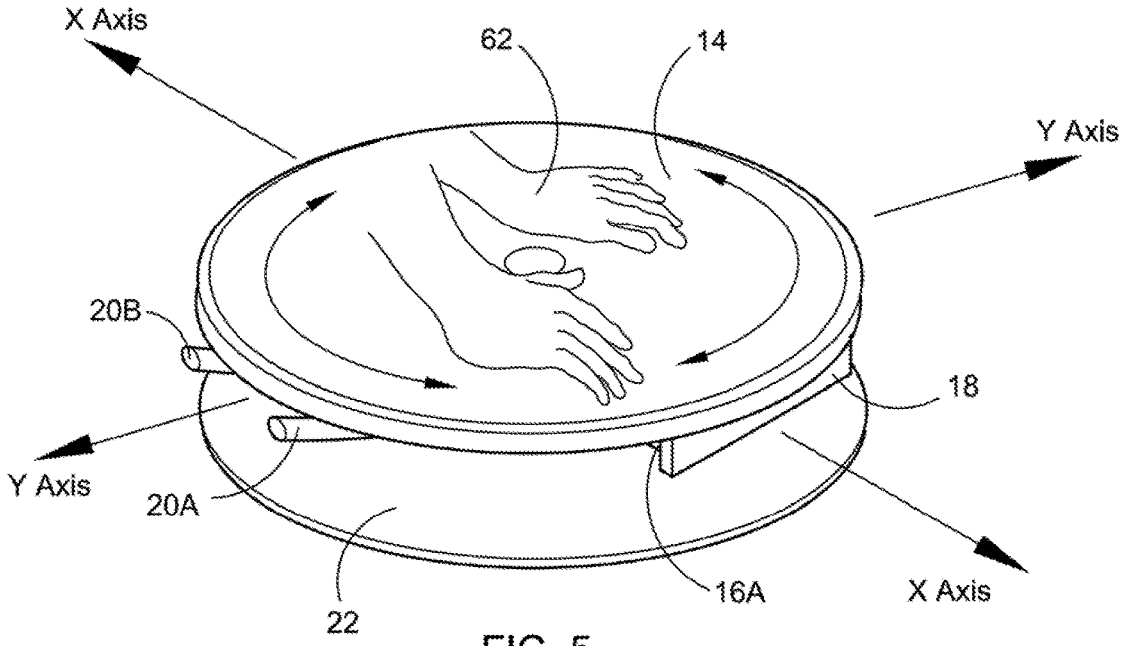
FIG. 5 depicts a perspective view of a person's hands on the preferred embodiment of the Multi-Planar Rotational Platform and Suspension Device.

FIG. 5 depicts a perspective view of a person's hands 62 on the preferred embodiment of the Multi-Planar Rotational Platform and Suspension Device 10A illustrating the use of the device for upper body movements and stability.

Figure 6:
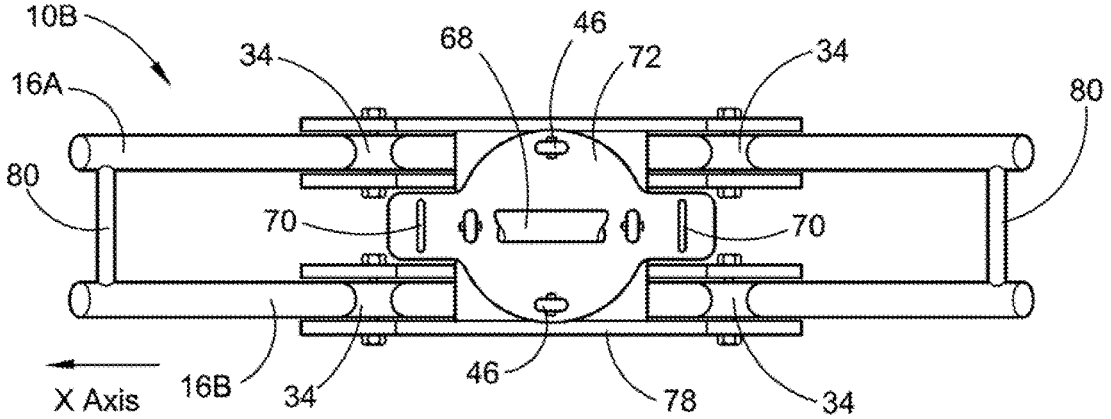
FIG. 6 depicts a top view of the first alternate embodiment of the Multi-Planar Rotational Platform and Suspension Device to be mounted on a vertical rod.

FIG. 6 depicts a top view of the first alternate embodiment of the Multi-Planar Rotational Platform and Suspension Device 10B mounted on a vertical rod 68 by clamps 70 to bearing shaft support plate 72 with rollers 46 on the perimeter for stability. The bearing shaft 24 extends from the bearing shaft support plate 72 through the bearing 44 in the frame top plate 74 of the frame 78. The curved round rails 16A and 16B are connected at the ends by a support bar 80 and translate through the contoured dolly rollers 34 in the frame 78 and will translate back and forth in the X-axis.

Figure 7:
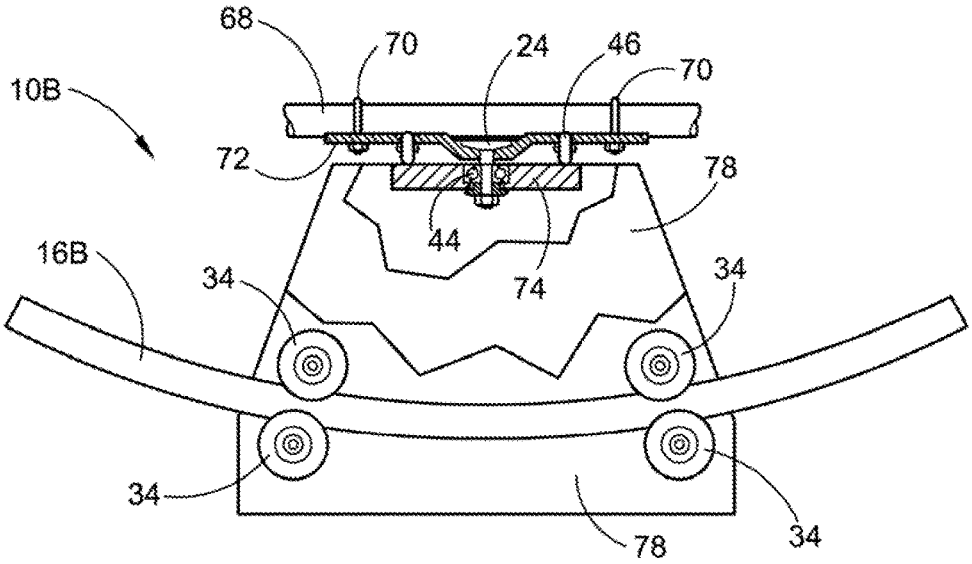
FIG. 7 depicts a side view of the first alternate embodiment of the Multi-Planar Rotational Platform and Suspension Device to be mounted on a vertical rod.

FIG. 7 depicts a side view of the first alternate embodiment of the Multi-Planar Rotational Platform and Suspension Device 10B to be mounted on a vertical rod 68 by clamps 70 to bearing shaft support plate 72 with rollers 46 on the perimeter for stability. The hearing shaft 24 extends from the bearing shaft support plate 72 through the bearing 44 in the frame top plate 74 of the frame 78. The curved round rails 16A and 16B are connected at the ends by a support bar 80 and will extend through the contoured dolly rollers 34 in the frame 78 and will translate back and forth in the X-axis.

Figure 8:
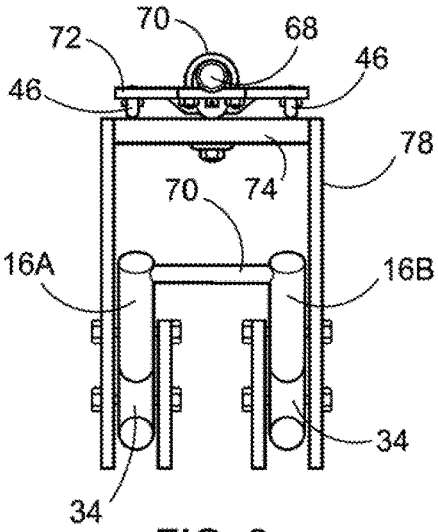
FIG. 8 depicts an end view of the first alternate embodiment of the Multi-Planar Rotational Platform and Suspension Device to be mounted on a vertical rod.

FIG. 8 depicts an end view of the first alternate embodiment of the Multi-Planar Rotational Platform and Suspension Device 10B to be mounted on a vertical rod 68, using any number of mounting methods such as a U-bolt type mount as shown.

Figure 9:
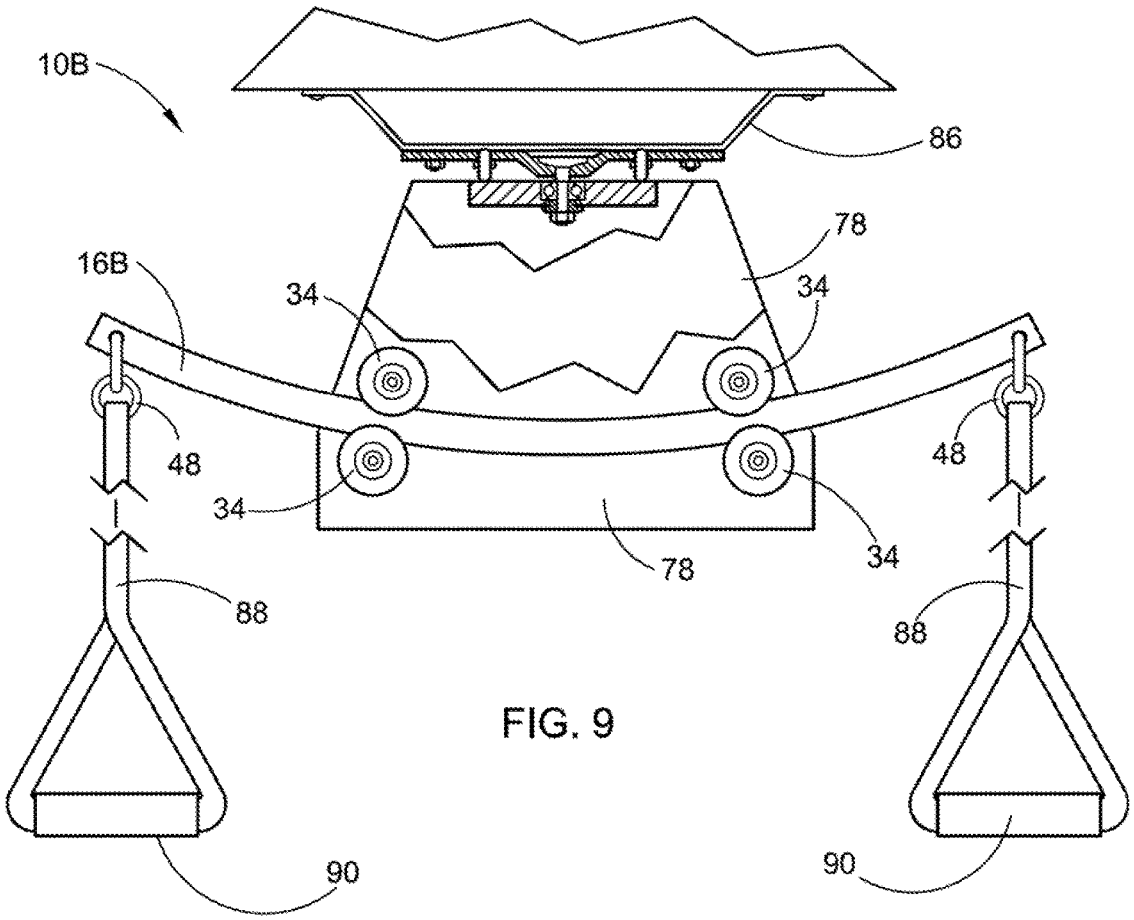
FIG. 9 depicts a view of the first alternate embodiment of the Multi-Planar Rotational Platform and Suspension Device to be mounted on the ceiling.

FIG. 9 depicts a view of the first alternate embodiment of the Multi-Planar Rotational Platform and Suspension Device 10B to be mounted on the ceiling with a ceiling mounting bracket 86. At the ends of the curved round rails 16A rings 48 are attached with straps 88 and hand grips 90.

Figure 10:
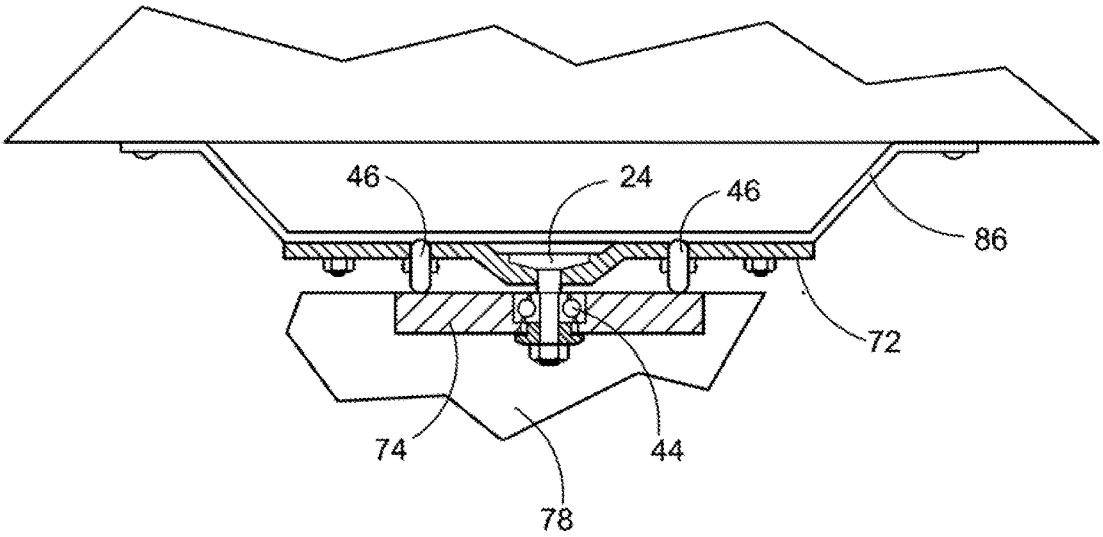
FIG. 10 depicts an enlarged side view of the rotational bearing section of the first alternate embodiment of the Multi-Planar Rotational Platform and Suspension Device.

FIG. 10 depicts an enlarged side view of the rotational bearing section of the first alternate embodiment of the Multi-Planar Rotational Platform and Suspension Device 10B to be mounted on the ceiling with a ceiling mounting bracket 86 to bearing shaft support plate 72 with rollers 46 on the perimeter for stability. The bearing shaft 24 extends from the bearing shaft support plate 72 through the bearing 44 in the frame top plate 74 of the frame 78. It is anticipated that in the suspended configuration, the device may have one or more trolleys and can achieve three separate planar motions, including rotational motion, using the rotational suspension system as shown. Thus, the suspended device can have all three planar motions integrated into the design by way of hawing one or more trolleys present, or by way of including a suspension means which enables one or more of the three planar motions.

FIG. 11 depicts a top view of the second alternate embodiment of the Multi-Planar Rotational Platform and Suspension Device 10C with the rotating platform 14 removed to clarify the internal mechanisms. The two of curved and contoured round rails 16C and 16D that are attached to the two rail mounting units 96 on the upper stationary plate 30 allowing the rotating platform 14 to rotate and rock back and forth on the X-axis. The dolly frame 32 freely translates back and forth by the means of the four contoured dolly rollers 34 on the corners. The four curved and contoured round rails segments 20C and 20D are attached on the Y-axis to dolly frame 32 and are supported by the means of four roller support units 98 on the base mounting plate 22. The contouring of the two curved and contoured round rails 16C and 16D and 20C and 20D has been designed to support the device with a single contoured dolly roller 34 on each roller support unit 98.

Figure 12:
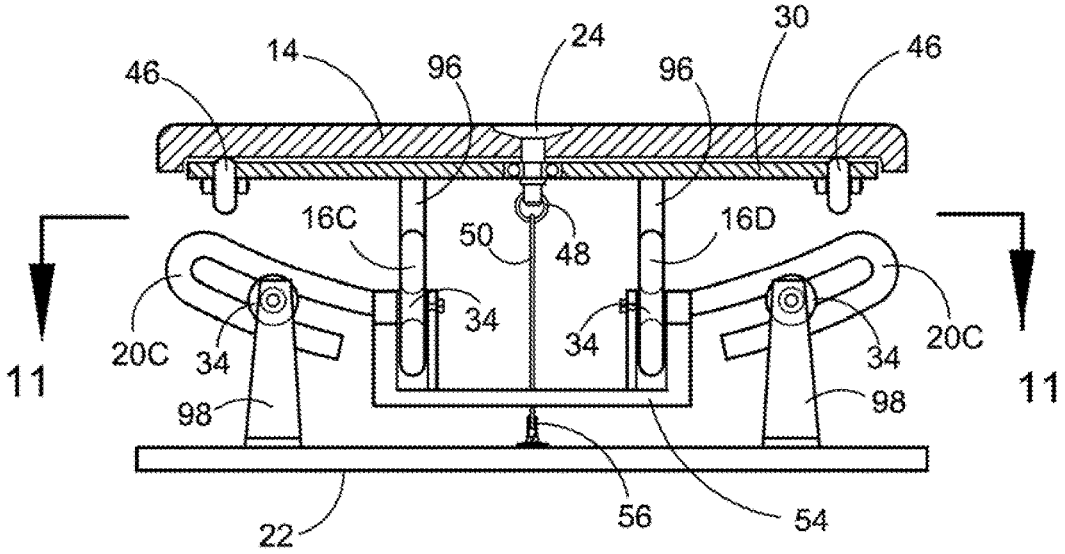
FIG. 12 depicts a front cross section view of the second alternate embodiment of the Multi-Planar Rotational Platform and Suspension Device.

FIG. 12 depicts a from cross section view of the second alternate embodiment of the Multi-Planar Rotational Platform and Suspension Device 10C illustrating the two curved and contoured round rails 16C and 16D are attached to the sides of the dolly frame 54 allowing it to freely translates back and forth on the X-axis by the means of the four contoured dolly rollers 34 on the corners. The four curved and contoured round rails segments 20C and 20D are attached on the Y-axis to dolly frame 32 and are supported by the means of four roller support units 98 on the base mounting plate 22. At the lower end of the bearing shaft 24 is a ring 48 attached to the tensioning cable 50 that goes down through an orifice 52 in the dolly frame 54 to a swivel pulley 56 mounted on the base mounting plate 22.

Figure 13:
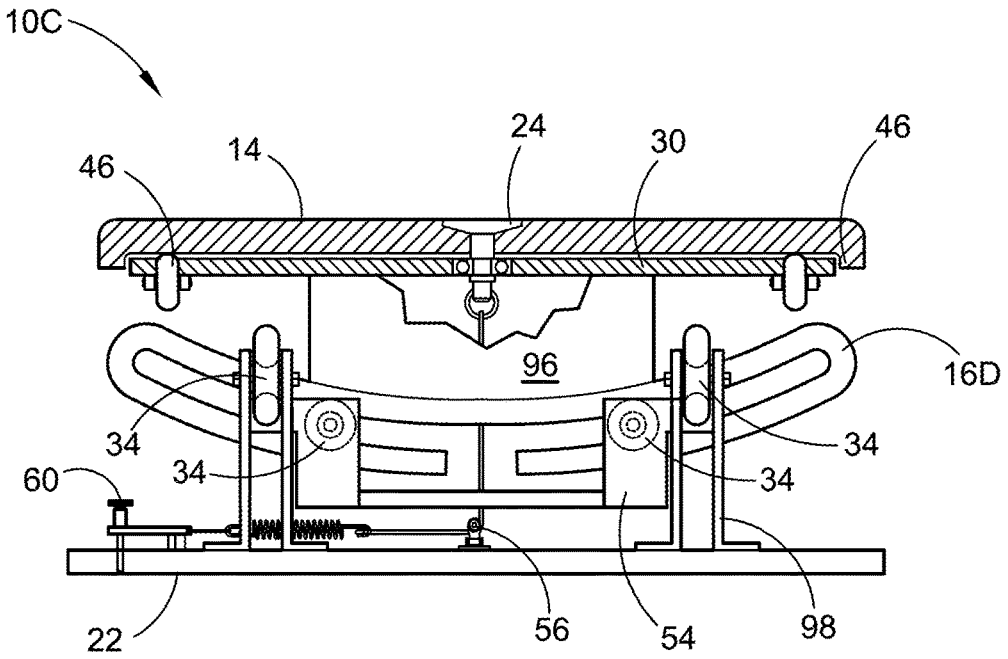
FIG. 13 depicts a side cross section view of the second alternate embodiment of the Multi-Planar Rotational Platform and Suspension Device.

FIG. 13 depicts a side cross section view of the second alternate embodiment of the Multi-Planar Rotational Platform and Suspension Device 10C illustrating the connection between the rail mounting plates 98 attached to the upper stationary plate 30 and the two curved contoured round rails 16C and 16D.

Figure 14:
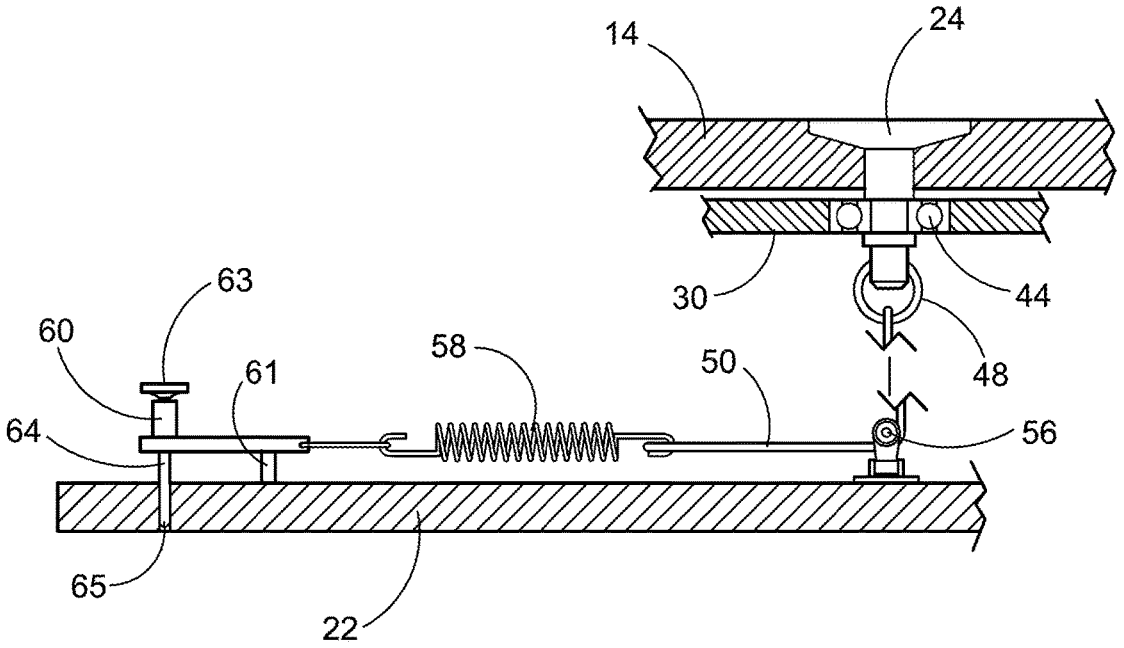
FIG. 14 depicts a section view of the tensioning mechanism used on the Multi-Planar Rotational Platform and Suspension Device.

FIG. 14 depicts a section view of the tensioning mechanism assembly where the lower end of the bearing shaft 24 is a ring 48 attached to the tensioning cable 50 to the swivel pulley 56 that is mounted on the base mounting plate 22 and then to the tensioning spring 58. The distal end of the tensioning spring 58 is attached to the adjustable tensioning lever 60. The tensioning adjustment lever 60 has a pivot point 61 rotatably affixed to the base mounting plate 22, a knob 63 which is connected to a pin 64, which when the knob 63 is raised that raises the pin 64 and removes the pin 64 from its current hole 65, and allowing the tensioning adjustment lever 60 to be moved such that the pin 64 can be replaced into another hole (see series of adjustment holes 66 located in the base mounting plate as shown in FIG. 2) thereby increasing the tension. The tensioning assembly shown works as in all conventional exercise device adjustment mechanisms, in that as the tensioning lever 60 is moved, the resulting tension on the tensioning cable 50 is increased (or decreased) and the downward pressure on the platform 14 is increased (or decreased) thereby restricting (or allowing for freer, less restrictive) movement of the platform in all directions.

Figure 15:
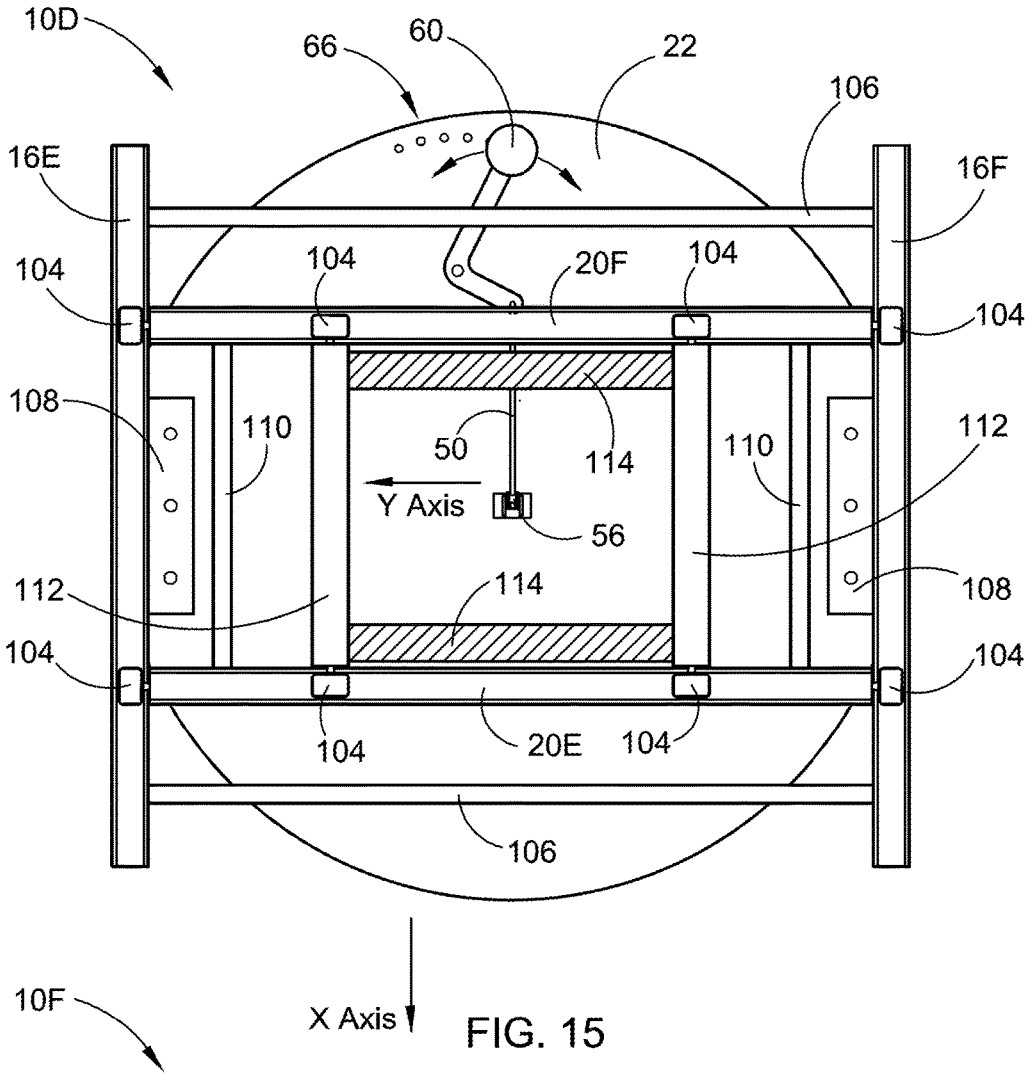
FIG. 15 depicts atop view of the third alternate embodiment of the Multi-Planar Rotational Platform and Suspension Device with the rotating platform removed to clarify the internal mechanisms.

FIG. 15 depicts a top view of the third alternate embodiment of the Multi-Planar Rotational Platform and Suspension Device 10D with the upper rotating platform 30 removed to clarify the internal mechanisms. The curved rails 16E and 16F and 20E and 20F have a flat track for the rollers or roller wheels 104. Curved rails 16E and 16F are connected by support bars 106 and attached to the base mounting plate 22 by angle mounts 108. Curved rails 20E and 20F are connected by two support bars 110 and create a trolley that travels on the X-axis. Upper trolley frame members 112 have rollers or roller wheels 104 on either end that ride in the flat track of the curved rails 16E and 16F and are connected by the two frame members 114 that are attached to the upper stationary plate 30. Here the tensioning adjustment lever 60 is shown as well as the series of adjustment holes 66 adjacent to the tensioning adjustment lever 60, with those adjustment holes 66 located in base mounting plate 22. The tensioning adjustment lever 60 moves in the direction of the arrows to place the pin over the desired adjustment hole within the series of adjustment holes 66.

Figure 16:
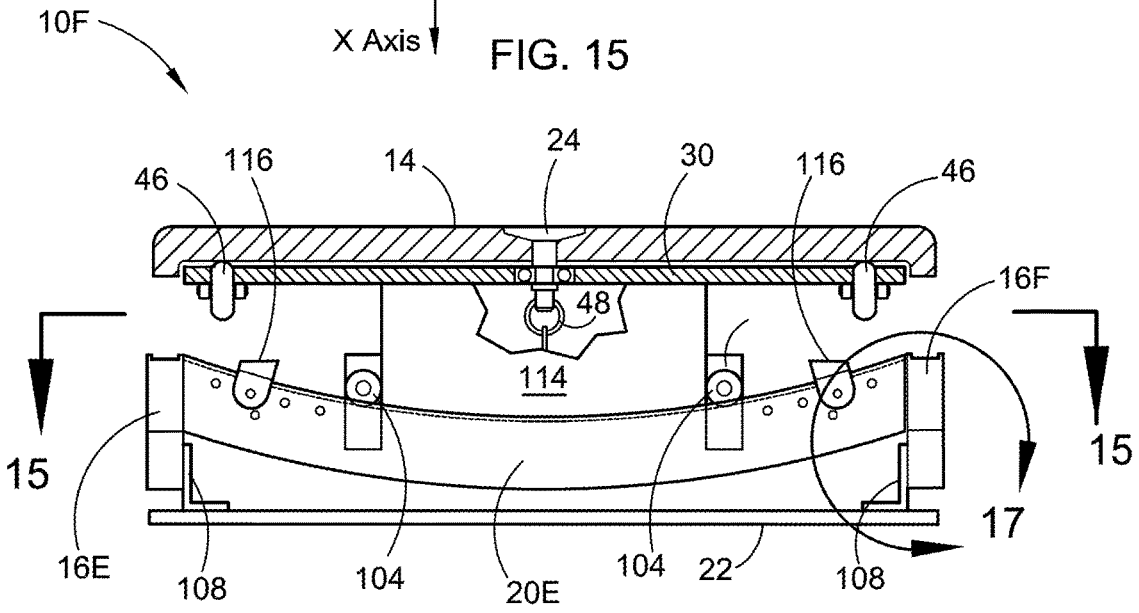
FIG. 16 depicts a front cross section view of the third alternate embodiment of the Multi-Planar Rotational Platform and Suspension Device.

FIG. 16 depicts a front cross section view of the fourth alternate embodiment of the Multi-Planar Rotational Platform and Suspension Device 10F. The curved rails 16E and 16F and 20E and 20F have a flat track for the rollers or roller wheels 104. Curved rails 16E and 16F are connected by support bars 106 and attached to the base mounting plate 22 by angle mounts 108. Curved rails 20E and 20F are connected by two support bars 110 and create a trolley that travels on the X-axis. Upper trolley frame members 112 have rollers or roller wheels 104 on either end that ride in the flat track of the curved rails 16E and 16F and are connected by the two frame members 114 that are attached to the upper stationary plate 30. Optional adjustable trolley stops 116 can be used to limit or change the length of the travel of the trolleys.

Figure 17:
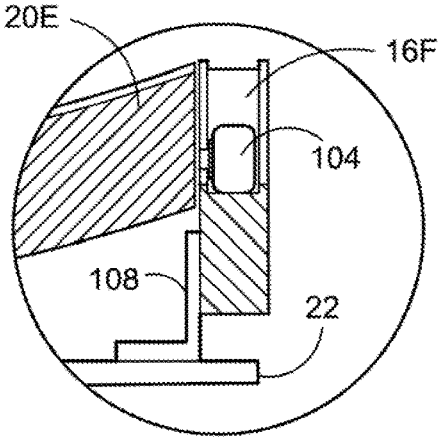
FIG. 17 depicts an enlarged cross section of the roller or roller wheel on the curved rail located in the trough of the curved rail.

FIG. 17 depicts an enlarged cross section of the roller or roller wheel 104 on the curved rail 20E located in the trough of the curved rail 16F.

Figure 18:
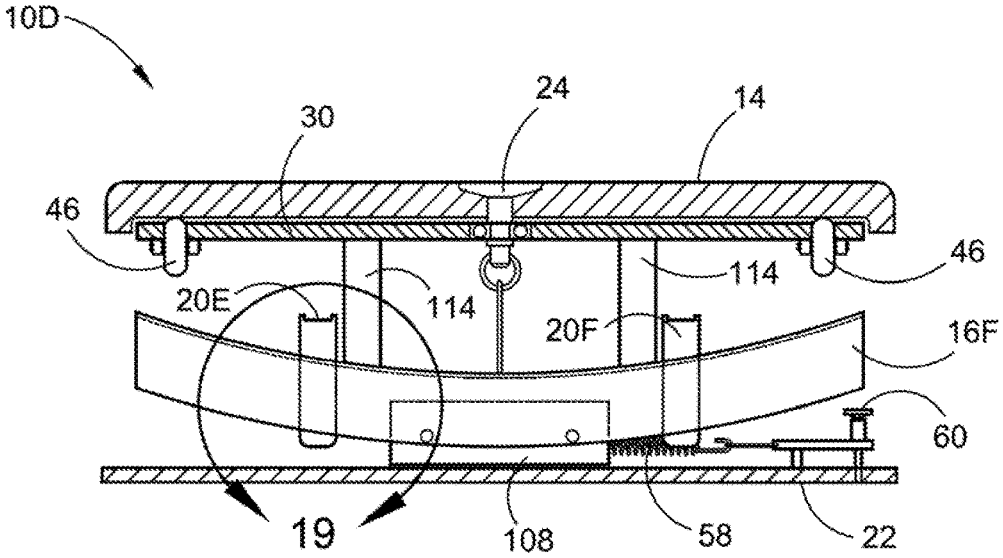
FIG. 18 depicts a side cross section view of the third alternate embodiment of the Multi-Planar Rotational Platform and Suspension Device.

FIG. 18 depicts a side cross section view of the third alternate embodiment of the Multi-Planar Rotational Platform and Suspension Device 10D. Here the tensioning adjustment lever 60 is shown having a knob and a pin wherein that pin is placed in one of the adjustment holes located in base mounting plate 22. In this way, the tensioning assembly and tensioning adjustment lever 60 shown works as in all conventional exercise device adjustment mechanisms.

Figure 19:
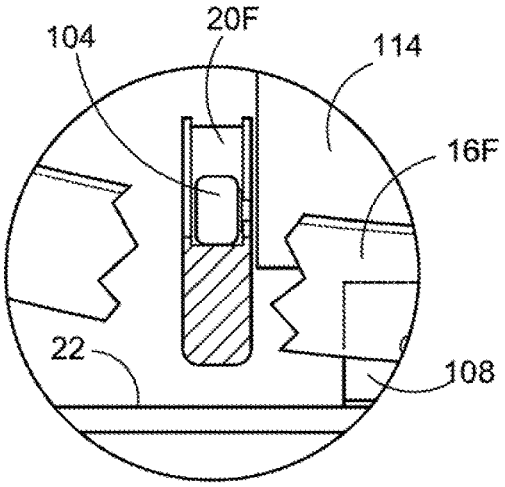
FIG. 19 depicts an enlarged cross section of the roller or roller wheel location on the curved rail located in the trough of the curved rail.

FIG. 19 depicts an enlarged cross section of the roller or roller wheel 104 location on the curved rail 20E located in the trough of the curved rail 16F.

Figure 20:
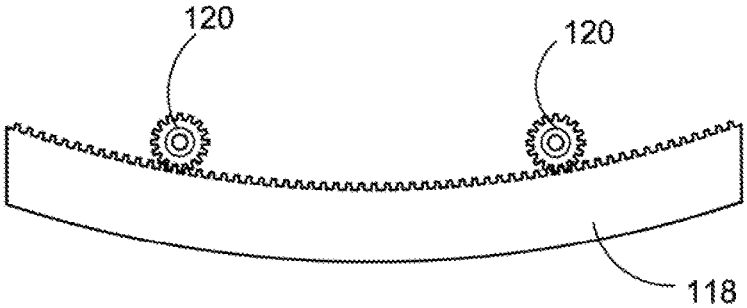
FIG. 20 depicts an optional design for the rail components.

FIG. 20 depicts an optional design for the rail curved rails components 16E and 16F and 20E and 20F using a rack 118 and pinion gear 120 configuration.

The Multi-Planar Rotational Platform and Suspension Device 10A, 10B, 10C, 10D, 10E and 10F shown in the drawings and described in detail herein disclose arrangements of elements of particular construction and configuration for illustrating preferred embodiments of structure and method of operation of the present Multi-Planar Rotational Platform and Suspension Device 10A, 10B, 10C, 10D, 10E and 10F. It is to be understood, however, that elements of different construction and configuration and other arrangements thereof, other than those illustrated and described may be employed for providing a Multi-Planar Rotational Platform and Suspension Device 10A, 10B, 10C, 10D, 10E and 10F in accordance with the spirit of this design, and such changes, alternations and modifications as would occur to those skilled in the art are considered to be within the scope of this Multi-Planar Rotational Platform and Suspension Device 10A, 10B, 10C, 10D, 10E and 10F as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the Multi-Planar Rotational Platform and Suspension Device of the application, which is measured by the claims, nor is it intended to be limiting as to the scope of the invention in any way.

I claim:

1. A multi-planar rotational platform and suspension device, comprising:

(a) a base plate supporting two or more individual trolley assemblies with each individual trolley assembly having two or more curved rails;

(b) two or more rollers rotationally attached to each of said trolley assemblies;

(c) a platform rotationally attached to said trolley assemblies; and (d) a tensioning assembly having a tensioning lever attached to said platform;

whereby said two or more trolley assemblies on said curved rails in contact with said rollers work in unison operating on three planar axes to move in the X-axis, Y-axis and the Z-axis, and further wherein platform rotation about a central axis is provided by the rotational attachment of the platform to the base plate, when pressure is applied to the surface of said platform.

2. The multi-planar rotational platform and suspension device, according to claim 1, wherein said platform rotationally attached to said trolley assemblies includes a stationary plate having a centrally located orifice and a bearing shaft extending through said centrally located orifice, and further wherein said bearing shaft makes rotational contact with a bearing ring including a plurality of bearings therein.

3. The multi-planar rotational platform and suspension device, according to claim 2, wherein said bearing shaft includes an upper portion and a lower portion and a ring securely affixed to said lower portion of said bearing shaft.

4. The multi-planar rotational platform and suspension device, according to claim 1, wherein said tensioning assembly having a tensioning lever includes;

(a) a tensioning cable;

(b) a swivel pulley mounted on said base plate; and (c) a tensioning spring attached to a tensioning adjustment lever;

wherein said tensioning cable further includes two ends with one tensioning cable end attached to said ring located on the lower end of said bearing shaft, and the other tensioning cable end threaded through said swivel pulley mounted on said base plate and attached to said tensioning spring attached to said tensioning adjustment lever.

5. The multi-planar rotational platform and suspension device, according to claim 4, wherein said tensioning adjustment lever is movably affixed to said base plate and further includes a tensioning adjustment lever knob attached to an adjustment lever pin.

6. The multi-planar rotational platform and suspension device, according to claim 1, wherein said rollers and curved rails are configured as mating rack-and-pinion gears.

7. An inverted multi-planar rotational platform and suspension device, comprising:

(a) an inverted base plate supporting two or more individual trolley assemblies with each individual trolley assembly having two or more curved rails, wherein said two or more trolley assemblies having two or more curved rails are suspended from said inverted base plate;

(b) two or more rollers rotationally attached to each of said trolley assemblies;

(c) a platform rotationally attached to said trolley assemblies; and (d) a tensioning assembly having a tensioning lever attached to said platform;

whereby said two or more trolley assemblies on said curved rails in contact with said rollers work in unison operating on three planar axes to move in the X-axis, Y-axis and the Z-axis, and further wherein platform rotation about a central axis is provided by the rotational attachment of the platform to the inverted base plate, when pressure is applied to the surface of said platform.

8. The inverted multi-planar rotational platform and suspension device, according to claim 7, wherein said inverted base plate is configured to be affixed to and suspended from a ceiling.

9. The multi-planar rotational platform and suspension device, according to claim 7, wherein said inverted base plate is configured to be affixed to and suspended from a bar affixed to a ceiling.

10. The multi-planar rotational platform and suspension device, according to claim 7, wherein said inverted base plate is configured to be affixed to and suspended from a ceiling, and further includes a base plate which is suspended from the ceiling using a mounting plate and swivel bearing axle attached to said base plate.

11. A method for making a multi-planar rotational platform and suspension device, comprising the steps of:

(a) providing a base plate supporting two or more individual trolley assemblies with each individual trolley assembly having two or more curved rails;

(b) providing two or more rollers rotationally attached to each of said trolley assemblies;

(c) providing a platform rotationally attached to said trolley assemblies; and (d) providing a tensioning assembly having a tensioning lever attached to said platform;

whereby said two or more trolley assemblies on said curved rails in contact with said rollers work in unison operating on three planar axes to move in the X-axis, Y-axis and the Z-axis, and further wherein platform rotation about a central axis is provided by the rotational attachment of the platform to the base plate, when pressure is applied to the surface of said platform.

12. The method for making a multi-planar rotational platform and suspension device, according to claim 11, wherein said platform rotationally attached to said trolley assemblies includes a stationary plate having a centrally located orifice and a bearing shaft extending through said centrally located orifice, and further wherein said bearing shaft makes rotational contact with a bearing ring including a plurality of bearings therein.

13. The method for making a multi-planar rotational platform and suspension device, according to claim 12, wherein said bearing shaft includes an upper portion and a lower portion and a ring securely affixed to said lower portion of said bearing shaft.

14. The method for making a multi-planar rotational platform and suspension device, according to claim 11, further including the step of providing a tensioning assembly having a tensioning lever comprising;

(a) a tensioning cable;

(b) a swivel pulley mounted on said base plate; and (c) a tensioning spring attached to a tensioning adjustment lever;

wherein said tensioning cable further includes two ends with one tensioning cable end attached to said ring located on the lower end of said bearing shaft, and the other tensioning cable end threaded through said swivel pulley mounted on said base plate and attached to said tensioning spring attached to said tensioning adjustment lever.

15. The method for making a multi-planar rotational platform and suspension device, according to claim 14, wherein said tensioning adjustment lever is movably affixed to said base plate and further includes a tensioning adjustment lever knob attached to an adjustment lever pin.

16. The method for making a multi-planar rotational platform and suspension device, according to claim 11, wherein said rollers and curved rails are configured as mating rack-and-pinion gears.

17. A method for making a multi-planar rotational platform and suspension device, comprising the steps of:

(a) providing an inverted base plate supporting two or more individual trolley assemblies with each individual trolley assembly having two or more curved rails, wherein said two or more trolley assemblies having two or more curved rails are suspended from said inverted base plate;

(b) providing two or more rollers rotationally attached to each of said trolley assemblies;

(c) providing a platform rotationally attached to said trolley assemblies; and (d) providing a tensioning assembly having a tensioning lever attached to said platform;

whereby said two or more trolley assemblies on said curved rails in contact with said rollers work in unison operating on three planar axes to move in the X-axis, Y-axis and the Z-axis, and further wherein platform rotation about a central axis is provided by the rotational attachment of the platform to the inverted base plate, when pressure is applied to the surface of said platform.

18. The method for making an inverted multi-planar rotational platform and suspension device, according to claim 17, wherein said inverted base plate is configured to be affixed to and suspended from a ceiling.

19. The method for making an inverted multi-planar rotational platform and suspension device, according to claim 17, wherein said inverted base plate is configured to be affixed to and suspended from a bar affixed to a ceiling.

20. The method for making an inverted multi-planar rotational platform and suspension device, according to claim 17, wherein said inverted base plate is configured to be affixed to and suspended from a ceiling, and further includes a base plate which is suspended from the ceiling using a mounting plate and swivel bearing axle attached to said base plate.

* * * * *